US006637937B2

(12) United States Patent
Bois

(10) Patent No.: US 6,637,937 B2
(45) Date of Patent: Oct. 28, 2003

(54) PACKAGING BAG HAVING CLOSURE STRIPS CONTROLLED BY A CURSOR

(75) Inventor: Henri Georges Bois, Neuilly sur Seine (FR)

(73) Assignee: Flexico France, Henonville (FR)

( * ) Notice: Subject to any disclaimer, the term of this patent is extended or adjusted under 35 U.S.C. 154(b) by 0 days.

(21) Appl. No.: 10/001,801

(22) Filed: Dec. 5, 2001

(65) Prior Publication Data

US 2002/0071617 A1 Jun. 13, 2002

(30) Foreign Application Priority Data

Dec. 7, 2000 (FR) ..... 00 15904

(51) Int. Cl.[7] ..... B65D 33/34

(52) U.S. Cl. ..... 383/5; 383/61.2; 383/64; 383/203

(58) Field of Search ..... 383/5, 61.2, 64, 383/202, 203, 204, 205

(56) References Cited

U.S. PATENT DOCUMENTS

| | | | | |
|---|---|---|---|---|
| 4,927,271 | A | 5/1990 | Branson | |
| 4,980,222 | A * | 12/1990 | Rivera et al. | 428/195 |
| 5,456,928 | A * | 10/1995 | Hustad et al. | 426/87 |
| 5,524,294 | A * | 6/1996 | Richardson et al. | 2/161.7 |
| 6,247,843 | B1 * | 6/2001 | Buchman | 383/5 |
| 6,264,366 | B1 * | 7/2001 | Custer | 383/5 |
| 6,286,999 | B1 * | 9/2001 | Cappel et al. | 383/5 |
| 6,287,000 | B1 * | 9/2001 | Buchman | 383/5 |

FOREIGN PATENT DOCUMENTS

| | | |
|---|---|---|
| EP | 0 941 937 | 9/1999 |
| EP | 1 053 947 | 11/2000 |
| FR | 2 546 481 | 11/1984 |

* cited by examiner

*Primary Examiner*—Jes F. Pascua
(74) *Attorney, Agent, or Firm*—Jacobson Holman PLLC

(57) ABSTRACT

A closure strip and a cursor of a bag. The bag including an indicator tape situated on the path of the cursor and designed to be ruptured when the bag is opened for the first time.

17 Claims, 2 Drawing Sheets

PACKAGING BAG HAVING CLOSURE STRIPS CONTROLLED BY A CURSOR

The present invention relates to the field of packaging bags having closure strips that can be opened and closed on multiple occasions.

BACKGROUND OF THE INVENTION

At present, the majority of such bags are fitted with a cursor designed to make it easier to open and close the bags respectively by separating and by joining together the closure strips.

In manner known per se, such cursors essentially define two channels receiving respective ones of the two closure strips, said channels being separated by a middle partition positioned between the two strips. The two channels converge towards one end of the cursor and diverge towards the other end.

Thus, depending on the displacement direction of the cursor, said cursor tends either to move the strips together into engagement in order to close the bag, or move them apart in order to open the bag.

In addition, there is currently a high demand for a system that serves to indicate when such bags are being opened for the first time.

On the market, such opening indicators are currently made in the form of a web disposed on the inside of the closure strips and connecting the two walls of the bag together, said web being designed to be ruptured when the bag is opened for the first time, as described in document FR-A-2 546 481, for example.

OBJECT AND SUMMARY OF THE INVENTION

An object of the present invention is to improve existing devices.

In the context of the present invention, this object is achieved by means of a packaging bag having closure strips, a cursor associated therewith, and at least one indicator tape disposed on the path of the cursor and designed to be ruptured by said cursor when the bag is opened for the first time, wherein the indicator tape is a two-tone tape and has respective different colors on its outside and inside faces.

BRIEF DESCRIPTION OF THE DRAWINGS

Other characteristics, objects, and advantages of the present invention will appear on reading the following detailed description and with reference to the accompanying drawings, given by way of non-limiting examples, in which.

MORE DETAILED DESCRIPTION

In their general structure, the bags, closure strips, and cursors used in the context of the present invention can be varied in any manner known to the person skilled in the art, in particular concerning their constituent material or their shape.

Under these circumstances, the elements are not described in detail below. In addition, they must not be considered as limited to the diagrammatic embodiments shown in the accompanying figures.

In the figures, general references 10, 20, and 30 are given respectively to the bags, to the closure strips, and to the cursor.

As mentioned above, in the context of the present invention, an indicator tape 40 is provided at the mouth of the bag, on the path of the cursor 30, such that said strip 40 is ruptured by the cursor when the bag is opened for the first time.

The indicator tape 40 is advantageously made of a plastics-based material.

Figure 1:
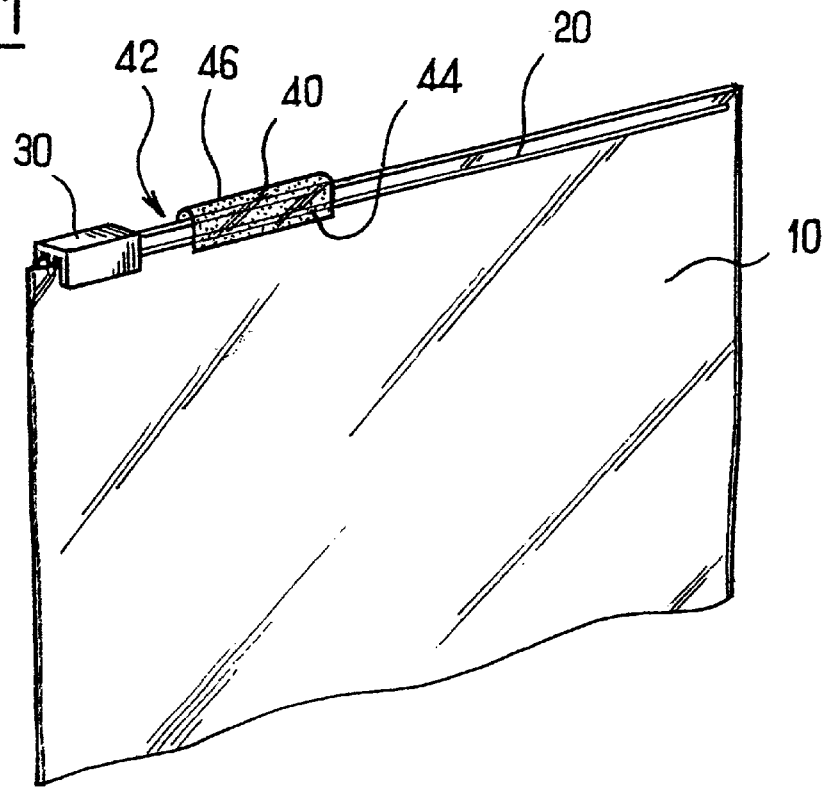
FIG. 1 is a diagrammatic, fragmentary, perspective view of a bag of the present invention.
Figure 2:
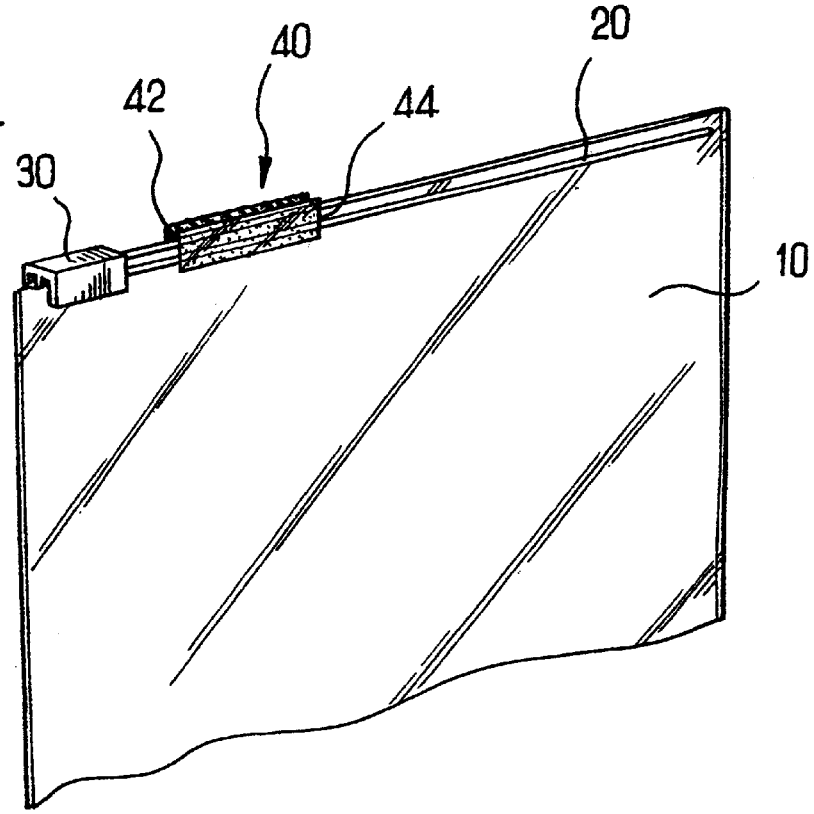
FIG. 2 is a similar diagrammatic view of the present invention after the indicator tape has been ruptured.

In a particular embodiment, shown in FIGS. 1 and 2, the indicator tape 40 is formed by a U-shaped strip of plastics material, having its concave side directed towards the body of the bag and having two limbs 42, 44 that are respectively fitted to the outside surfaces of the two main walls of the bag and that are fixed thereto by any suitable means, e.g. by adhesive or by heat sealing.

Still more precisely, the strip 40 is situated adjacent to the cursor 30 when said cursor is situated in the bag-closed position. Thus, as soon as the cursor 30 is displaced for the first time, the cursor 30 bears against the strip 40 in order to rupture it.

FIG. 2 shows an indicator tape 40 that has been ruptured by displacement of the cursor 30.

If necessary, several discontinuous or distinct indicator tapes 40 can thus be distributed along the mouth of the bag in order to make it easier to see that the bag has been opened.

Figure 3:
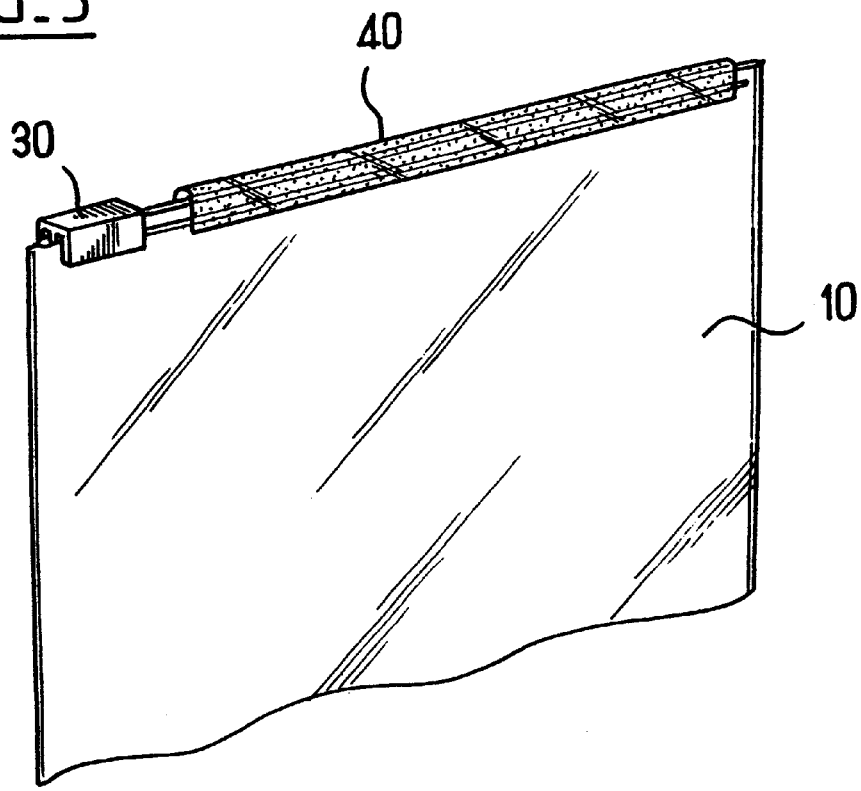
FIG. 3 is a similar diagrammatic view of a bag constituting a variant embodiment of the present invention.

In a variant, as shown in FIG. 3, a continuous indicator tape 40 can be provided along the entire length of the mouth of the bag.

In addition, it is advantageous to make the indicator tape 40 in the form of a colored strip having a color that is different from the rest of the bag so that it is easier to see that the bag has been opened.

More precisely, in the invention, and as can be seen in FIG. 2, the indicator tape 40 is a two-tone tape: it has a first color on its outside face which is the only color that is visible before rupture, and a second color on its inside face which is different from the first and which appears after rupture so that the rupture can be clearly seen.

Figure 4:
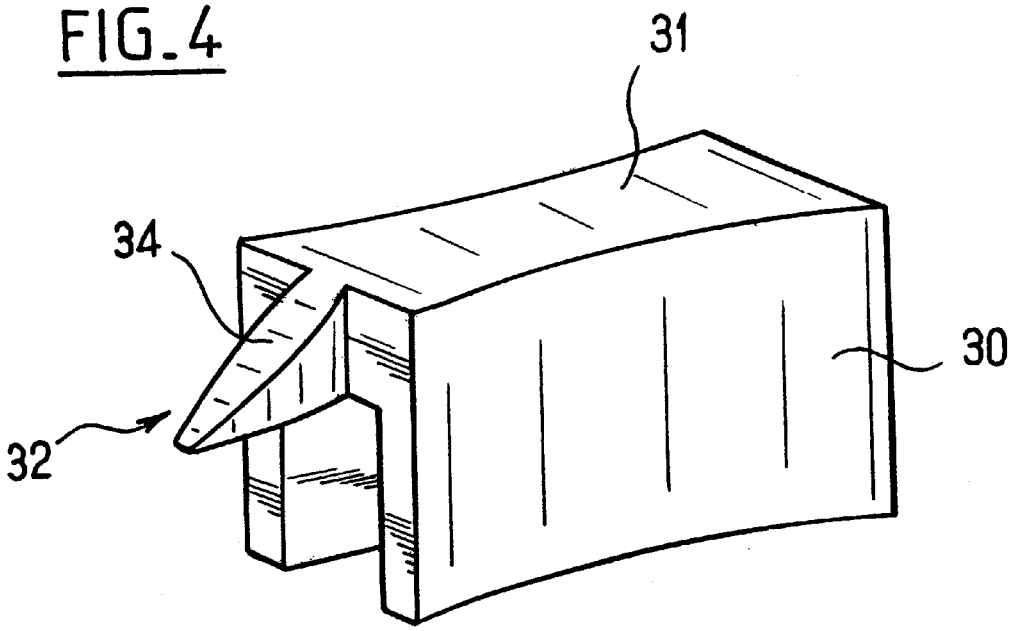
FIG. 4 is a diagrammatic, perspective view of a cursor constituting a preferred embodiment of the present invention.

In yet another advantageous characteristic of the invention, the indicator tape 40 can include a longitudinal perforated line 46, making said strip rupture more easily when the cursor 30 bears thereon.

Where necessary, and as can be seen in FIG. 4, the end of the cursor 30 originally adjacent to the indicator tape 40 can be provided with a blade or a projection 32 designed to bear on the indicator tape 40 via its inside face, thereby making said strip rupture more easily.

The blade 32 advantageously has a top face 34 sloping relative to the top face 31 of the cursor in order to ensure that the blade 32 engages the indicator tape 40 progressively. As can be seen in FIG. 4, towards its end, the top 34 of the blade 32 departs from the plane of the top face 31 of the cursor 30.

Naturally, such a blade 32 is advantageously made integrally with the cursor 30 out of the same material, e.g. by molding.

The present invention is not limited to the embodiments described above, but extends to any variant within the spirit of the invention.

What is claimed is:

1. A bag having a closure strip, a cursor, and an indicator tape, the improvement comprising said indicator tape having an inside face and an outside face and being situated on a path of the cursor so as to be ruptured when the bag is opened for the first time, the indicator tape being a two-tone tape having a respective different color on the outside face and the inside face.

2. A bag according to claim 1, wherein the indicator tape is made of plastics material.

3. A bag according to claim 1, wherein the indicator tape is situated adjacent to the cursor when said cursor is in a closed position.

4. A bag according to claim 1, wherein the indicator tape is U-shaped.

5. A bag according to claim 1, wherein the indicator tape is U-shaped, having a concave side directed towards a body of the bag.

6. A bag according to claim 1, wherein the indicator tape is continuous.

7. A bag according to claim 1, wherein the indicator tape extends along a length of a mouth of the bag.

8. A bag according to claim 1, wherein the indicator tape is different in color from a body of the bag.

9. A bag according to claim 1, wherein the indicator tape includes a longitudinal perforated line.

10. A bag according to claim 1, wherein the cursor is fitted with a blade adjacent to the indicator tape.

11. A bag according to claim 10, wherein the blade has a sloping top face.

12. A packaging bag comprising a closure strip, a cursor, and a single layer indicator tape having an inside face of one color and an outside face of a different color, said indicator tape being situated on a path of the cursor and being ruptured when the bag is opened for the first time by movement of the cursor so as to visually expose said one color of the inside face of the indicator tape and evidence opening of the bag.

13. A bag according to claim 12, wherein the indicator tape is made of plastics material.

14. A bag according to claim 12, wherein the indicator tape is different in color from a body of the bag.

15. A bag according to claim 12, wherein the indicator tape includes a longitudinal perforated line.

16. A bag according to claim 12, wherein the cursor is fitted with a blade adjacent to the indicator tape.

17. A bag according to claim 16, wherein the blade has a sloping top face.

* * * * *